United States Patent [19]

Di Biase et al.

[11] Patent Number: 5,015,368

[45] Date of Patent: May 14, 1991

[54] ORE FLOTATION PROCESS USING CARBAMATE COMPOUNDS

[75] Inventors: Stephen A. Di Biase, Euclid; James H. Bush, Mentor, both of Ohio

[73] Assignee: The Lubrizol Corporation, Wickliffe, Ohio

[21] Appl. No.: 538,864

[22] Filed: Jun. 15, 1990

[51] Int. Cl.[5] ..... B03D 1/012; B03D 1/02

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 1,726,647 | 9/1929 | Cadwell . | |
| 1,736,429 | 11/1929 | Cadwell . | |
| 3,298,520 | 1/1967 | Bikales | 209/166 |
| 3,425,550 | 2/1969 | Baarson | 209/166 |
| 3,464,551 | 9/1969 | Falvey | 209/166 |
| 3,590,997 | 7/1971 | Harris | 209/166 |
| 3,876,550 | 4/1975 | Holubec | 252/47.5 |
| 4,372,864 | 2/1983 | McCarthy | 252/61 |
| 4,514,293 | 4/1985 | Bresson et al. | 209/167 |
| 4,554,108 | 11/1985 | Kimble et al. | 260/455 A |
| 4,699,711 | 10/1987 | Bergman | 209/166 |
| 4,806,234 | 2/1989 | Bresson | 209/167 |

FOREIGN PATENT DOCUMENTS

| | | | |
|---|---|---|---|
| 771181 | 11/1967 | Canada | 209/166 |
| 771182 | 11/1967 | Canada | 209/166 |
| 50-50202 | 5/1975 | Japan | 209/166 |
| 381399 | 9/1971 | U.S.S.R. | 209/166 |
| 383472 | 12/1971 | U.S.S.R. | 209/166 |
| 1131085 | 11/1985 | U.S.S.R. | 209/166 |

*Primary Examiner*—Stanley Silverman
*Assistant Examiner*—Thomas M. Lithgow
*Attorney, Agent, or Firm*—Robert A. Franks; Frederick D. Hunter; Forrest L. Collins

[57] ABSTRACT

The present invention relates to an improved process for beneficiating an ore. In particular, the process is useful for beneficiating ores and recovering metal values such as gold, copper, lead, molybdenum, zinc, etc., from the ores. In one embodiment, the process comprises (A) forming a slurry comprising at least one crushed mineral-containing ore, water and a collector which is at least one carbamate represented by the formula:

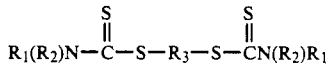

$$R_1(R_2)N-\overset{\overset{\displaystyle S}{\|}}{C}-S-R_3-S-\overset{\overset{\displaystyle S}{\|}}{C}N(R_2)R_1 \qquad (I)$$

wherein each $R_1$ is independently hydrogen, a hydrocarbyl group having from 1 to about 18 carbon atoms, or $R_1$ taken together with $R_2$ and the nitrogen atom form a five, six or seven member heterocyclic group; each $R_2$ is independently a hydrocarbyl group having from 1 to about 18 carbon atoms, or $R_2$ taken together with $R_1$ and the nitrogen atom form a five, six or seven member heterocyclic group; and $R_3$ is a hydrocarbylene group having from 1 to about 10 carbon atoms;

(B) subjecting the slurry from step (A) to froth flotation to produce a froth; and (C) recovering a mineral from the froth.

22 Claims, No Drawings

ORE FLOTATION PROCESS USING CARBAMATE COMPOUNDS

TECHNICAL FIELD OF THE INVENTION

This invention relates to froth flotation processes for the recovery of metal values from metal ores. More particularly, it relates to the use of improved collectors comprising carbamate compounds.

BACKGROUND OF THE INVENTION

Froth flotation is one of the most widely used processes for beneficiating ores containing valuable minerals. It is especially useful for separating finely ground valuable minerals from their associated gangue or for separating valuable minerals from one another. The process is based on the affinity of suitably prepared mineral surfaces for air bubbles. In froth flotation, a froth or a foam is formed by introducing air into an agitated pulp of the finely ground ore in water containing a frothing or foaming agent. A main advantage of separation by froth flotation is that it is a relatively efficient operation at a substantially lower cost than many other processes.

It is common practice to include in the flotation process, one or more reagents called collectors or promoters that impart selective hydrophobicity to the valuable mineral that is to be separated from the other minerals. It has been suggested that the flotation separation of one mineral species from another depends upon the relative wettability of mineral surfaces by water. Many types of compounds have been suggested and used as collectors in froth flotation processes for the recoverY of metal values. Examples of such types of collectors include the xanthates, xanthate esters, dithiophosphates, dithiocarbamates, trithiocarbonates, mercaptans and thionocarbonates.

U.S. Pat. No. 3,298,520 issued to Bikales relates to the use of 2-cyanovinyldithiocarbamates which are useful as promotors in benefication of ores by froth flotation.

U.S. Pat. No. 4,372,864 issued to McCarthy relates to a reagent which is useful in the recovery of bituminous coal in froth flotation processes. The reagent of the invention comprises a liquid hydrocarbon, a reducing material and an activator material. The reducing material is phosphorus pentasulfide and the activator material is zinc ethylene bis(dithiocarbamate).

U.S. Pat. No. 4,514,293 issued to Bresson et al and U.S. Pat. No. 4,554,108 issued to Kimble et al relate to the use of N-carboxyalkyl-S-carboalkoxydithiocarbamates and carboxyalkyldithiocarbamates, respectively, as ore flotation reagents.

U.S. Pat. No. 4,595,538 issued to Kimble et al relates to the use of trialkali metal or triammonium N,N-bis(-carboxyalkyl)dithiocarbamates as ore flotation depressants.

U.S. Pat. No. 3,876,550 issued to Holubec relates to lubricant compositions containing an additive combination which comprises (A) an alkylene dithiocarbamate and (B) a rust inhibitor based on a hydrocarbon-substituted succinic acid or certain derivatives thereof.

U.S. Pat. Nos. 1,726,647 and 1,736,429 issued to Cadwell relate to phenylmethylene bisdithiocarbamates and methods for preparing the same.

SUMMARY OF THE INVENTION

The present invention relates to an improved process for beneficiating an ore. In particular, the process is useful for beneficiating ores and recovering metal values such as gold, copper, lead, molybdenum, zinc, etc. In one embodiment, the process comprises (A) forming a slurry comprising at least one crushed mineral-containing ore, water and a collector which is at least one dithiocarbamate represented by the formula:

$$R_1(R_2)N-\overset{\overset{\displaystyle S}{\|}}{C}-S-R_3-S-\overset{\overset{\displaystyle S}{\|}}{C}N(R_2)R_1 \qquad (1)$$

wherein each $R_1$ is independently hYdrogen, a hydrocarbyl group having from 1 to about 18 carbon atoms, or $R_1$ taken together with $R_2$ and the nitrogen atom form a five, six or seven member heterocyclic group; each $R_2$ is independently a hydrocarbyl group having from 1 to about 18 carbon atoms, or $R_2$ taken together with $R_1$ and the nitrogen atom form a five, six or seven member heterocyclic group; and $R_3$ is a hydrocarbylene group having from 1 to about 10 carbon atoms;

(B) subjecting the slurry from step (A) to froth flotation to produce a froth; and (C) recovering a mineral from the froth.

DETAILED DESCRIPTION OF THE INVENTION

In the specification and claims, the term hydrocarbylene or alkylene is meant to refer to a divalent hydrocarbyl or hydrocarbon groups, respectively.

The term "hydrocarbyl" includes hydrocarbon, as well as substantially hydrocarbon, groups. Substantially hydrocarbon describes groups which contain non-hydrocarbon substituents which do not alter the predominantly hydrocarbon nature of the group. Non-hydrocarbon substituents include halo (especially chloro and fluoro), hydroxy, alkoxy, mercapto, alkylmercapto, nitro, nitroso, sulfoxy, etc., groups. The hydrocarbyl group may also have a heteroatom, such as sulfur, oxygen, or nitrogen, in a ring or chain. In general, no more than about 2, preferably no more than one, non-hydrocarbon substituent will be present for every ten carbon atoms in the hydrocarbyl group. Typically, there will be no such non-hydrocarbon substituents in the hydrocarbyl group. Therefore, the hydrocarbyl group is purely hydrocarbon.

The froth flotation process of the present invention is useful to beneficiate mineral and metal values including, for example, gold, copper, lead, molybdenum, zinc, etc. Gold can be beneficiated as native gold or from such gold-bearing minerals as sylvanite ($AuAgTe_2$) and calaverite (AuTe). Silver can be beneficiated from argentite ($Ag_2S$). Lead can be beneficiated from minerals such as galena (PbS) and zinc can be beneficiated from minerals such as sphalerite (ZnS). Cobalt-nickel sulfide ores such as siegenite or linnalite can be beneficiated in accordance with this invention. Copper can be beneficiated from such ores as chalcopyrites ($CuFeS_2$), calcocite ($Cu_2S$), covellite (CuS), bornite ($Cu_5FeS_4$) and copper-containing minerals commonly associated therewith.

In the following description of the invention, however, comments primarily will be directed toward the beneficiation and recovery of gold minerals, and it is intended that such discussion shall also apply to the other above-identified minerals. The process of the present invention has been found to be particularly useful in beneficiating gold-bearing ores such as those found in the West of the United States of America.

The ores which are treated in accordance with the process of the present invention must be reduced in particle size to provide ore particles of flotation size. As is apparent to those skilled in the art, the particle size to which an ore must be reduced in order to liberate mineral values from associated gangue and non-value metals will varY from ore to ore and depends upon several factors, such as, for example, the geometry of the mineral deposits within the ore, e.g., striations, agglomerations, etc. Generally, suitable particle sizes are minus 10 mesh (1000 microns) (Tyler) with 50% or more of the particles passing 200 mesh (70 microns). The size reduction of the ores may be performed in accordance with any method known to those skilled in the art. For example, the ore can be crushed to about minus 10 mesh (1000 microns) size followed by wet grinding in a steel ball mill to specified mesh size ranges. Alternatively, pebble milling may be used. The procedure used in reducing the particle size of the ore is not critical to the method of this invention so long as particles of effective flotation size are provided.

Water is added to the grinding mill to facilitate the size reduction and to provide an aqueous pulp or slurry. The amount of water contained in the grinding mill be varied depending on the desired solid content of the pulp or slurry obtained from the grinding mill. Conditioning agents may be added to the grinding mill prior to or during the grinding of crude ore. Optionally, water-soluble inorganic bases and/or collectors also may be included in the grinding mill.

At least one collector of the present invention is added to the grinding mill to form the aqueous slurry or pulp. The collector may be added prior to, during, or after grinding of the crude ore. The collectors useful in the present invention may be represented by the Formula:

$$R_1(R_2)N-\overset{\overset{\displaystyle S}{\|}}{C}-S-R_3-S-\overset{\overset{\displaystyle S}{\|}}{C}-N(R_2)R_1 \qquad \text{(I)}$$

wherein $R_1$, $R_2$ and $R_3$ are defined below.

Each $R_1$ is independently a hydrogen; a hydrocarbyl group having from 1 to about 18 carbon atoms, preferably 1 to about 10, more preferably 1 to about 6; or $R_1$ taken together with $R_2$ and the nitrogen atom form a five, six or seven member heterocyclic group. Preferably, each $R_1$ is hydrogen or an alkyl group, more preferably hydrogen or a propyl, butyl, amyl or hexyl group, more preferably a butyl group. The above list encompasses all stereo arrangements these groups, including isopropyl, n-propyl, sec-butyl, isobutyl, and n-butyl.

Each $R_2$ is independently a hydrocarbyl group having from 1 to about 18 carbon atoms, or $R_2$ taken together with $R_1$ and the nitrogen atom form a five, six or seven member heterocyclic group. When $R_2$ is a hydrocarbyl group, it is defined the same as when $R_1$ is a hydrocarbyl group.

When $R_1$ and $R_2$ are taken together with a nitrogen atom to form a five, six or seven member heterocyclic group, the heterocyclic group is a pyrrolidinyl, a piperidinyl, a morpholinyl or a piperazinyl group. The heterocyclic group may contain one or more, preferably one to three alkyl substituents on the heterocyclic ring. The alkyl substituents preferably contain from about one to about six carbon atoms. Examples of heterocyclic groups include 2-methylmorpholinyl, 3-methyl-5-ethylpiperidinyl, 3-hexylmorpholinyl, tetramethylpyrrolidinyl, piperazinyl, 2,5-dipropylpiperazinyl, piperidinyl, 2-butylpiperazinyl, 3,4,5-triethylpiperidinyl, 3-hexylpyrrolidinyl, and 3-ethyl-5-isopropylmorpholinyl groups. Preferably, the heterocyclic group is a pyrrolidinyl or piperidinyl group.

In one embodiment, each $R_1$ is independently a hydrogen, or a hydrocarbyl group and each $R_2$ is independently a hydrocarbyl group. In another embodiment, one $R_1$ and $R_2$ taken together with a nitrogen atom form a five, six or seven member heterocyclic group while the other $R_1$ is independently a hydrogen or a hydrocarbyl group and the other $R_2$ is a hydrocarbyl group. In another embodiment, each $R_1$ and $R_2$ taken together with the nitrogen atom form a five, six or seven member heterocyclic group.

$R_3$ is a hydrocarbylene group having from 1 to about 10 carbon atoms, preferably 1 to about 4, more preferably 1 or 2. Preferably, $R_3$ is an alkylene, arylene, alkarylene, or arylalkylene. In one embodiment, $R_3$ is an alkylene group, preferably, a methylene or ethylene group, more preferably methylene.

In another embodiment, $R_3$ is an arylene group, alkarylene group, or arylalkylene group having from 6 to about 10 carbon atoms, preferably 6 to about 8. Preferably, $R_3$ is a phenylmethylene, phenylethylene, phenyldiethylene, phenylene, tolylene, etc.

The dithiocarbamates useful as collectors in the present invention may be prepared by the reaction of a salt of a dithiocarbamic acid with a suitable dihalogen containing hydrocarbon in the presence of a suitable reaction medium. Suitable reaction media include alcohols, such as ethanol and methanol; ketones, such as acetone or methylethylketone; ethers, such as dibutylether or dioxane; and hydrocarbons, such as petroleum ether, benzene and toluene. The reaction is generally carried out at a temperature within the range of about 25° C. to about 150° C., more preferably about 25° C. to about 100° C.

U.S. Pat. No. 3,876,550 issued to Holubec describes lubricant compositions containing alkylene dithiocarbamic compounds. U.S. Pat. Nos. 1,726,647 and 1,736,429 issued to Cadwell describes phenylmethylene bis(dithiocarbamates) and methods of making the same. These patents are incorporated by reference for their teachings related to dithiocarbamate compounds and methods for preparing the same.

The following example relates to dithiocarbamate useful in the process of the present invention.

EXAMPLE 1

A reaction vessel is charged with 1000 parts (7.75 moles) of di-n-butylamine, 650 parts (8.1 moles) of a 50% aqueous solution of sodium hydroxide, and 1356 parts of water. Carbon disulfide (603 parts, 7.9 moles) is added to the above mixture while the temperature of the reaction mixture is maintained under about 63° C. After completion of the addition of the carbon disulfide, methylene dichloride (363 parts, 4.3 moles) is added over four hours while the reaction mixture is heated to 88° C. After the addition of methylene dichloride, the mixture is heated for an additional three hours at a temperature in the range of 85° C.–88° C. The stirring is stopped and the aqueous phase is drained off. The reaction mixture is stripped to 150° C. and 50 millimeters of mercury. The residue is filtered. The filtrate has 6.5% nitrogen and 30.0% sulfur.

The amount of the collector of the present invention included in the slurry to be used in the flotation process is an amount which is effective in promoting the froth flotation process and providing improved separation of the desired mineral values. The amount of collector of the present invention included in the slurry will depend upon a number of factors including the nature and type of ore, size of ore particles, etc. In general, the amount of collector is from about 0.5 to about 500 parts of collector per million parts of ore, preferably about 1 to about 50, more preferably about 1.5 to about 40.

In the process of the present invention, a base may be used to provide desirable pH values. Desirable pH values are about 8 and above, preferably about 8 to about 13, more preferably about 9 to about 12, with about 10 to about 12 being highly preferred. Alkali and alkaline earth metal oxides and hydroxides are useful inorganic bases. Lime is a particularly useful base. In the process of the present invention, it has been discovered that the addition of a base to the ore or slurry containing the collectors of this invention results in a significant increase in the gold assay of the cleaner concentrates.

The slurries of this invention will contain from about 20% to about 50% by weight of solids, and more generally from about 30% to 40% solids. Such slurries can be prepared by mixing all the above ingredients. Alternatively, the collector and inorganic base can be premixed with the ore either as the ore is being ground or after the ore has been ground to the desired particle size. Thus, in one embodiment, the ground pulp is prepared by grinding the ore in the presence of an inorganic base. The collector is added to the ground pulp and this mixture is thereafter diluted with water to form the slurry. The amount of inorganic base included in the ground ore and/or the slurry prepared from the ore is an amount which is sufficient to provide the desired pH to the slurry. Generally, the amount of inorganic base is from about 250 to about 2000 parts of inorganic base per million parts of ore, preferably from about 375 to about 1500. This amount may be varied by one skilled in the art depending on particular preferences.

In step (B), the slurry may be subjected to a froth flotation to form a froth and an underflow. Most of the gold values are recovered in the froth (concentrate) while significant quantities of undesirable minerals and gangue remain in the underflow. The flotation stage of the flotation system comprises at least one flotation stage wherein a rougher concentrate is recovered, and/or one or more cleaning stages wherein the rougher concentrate is cleaned and upgraded. Tailing products from each of the stages can be routed to other stages for additional mineral recovery.

The gold rougher flotation stage will contain at least one frother, and the amount of frother added will be dependent upon the desired froth characteristics which can be selected with ease by one skilled in the art. A typical range of frother addition is from about 20 to about 50 parts of frother per million parts of ore.

A wide variety of frothing agents have been used successfully in the flotation of minerals from ores and any of the known frothing agents can be used in the process of the present invention. By way of illustration, such frothing agents as straight or branched chain low molecular weight hydrocarbon alcohols such as $C_{6-8}$ alkanols, 2-ethylhexanol and 4-methyl-2-pentanol (also known as methylisobutylcarbinol, or MIBC) may be employed as well as pine oils, cresylic acid, polyglycol or monoethers of polyglycols and alcohol ethoxylates.

An essential ingredient of the slurry contained in the gold rougher stage is one or more of the collectors described above. In one embodiment, the collector is included in the slurry in step (A), and additional collector may be added during the flotation steps including the rougher stage as well as the cleaner stage. In addition to the collectors of the present invention, other types of collectors normally used in the flotation of ores can be used. The use of such auxiliary collectors in combination with the collectors of this invention often results in improved and superior recovery of more concentrated metal values. These auxiliary collectors also may be added either to the rougher stage or the cleaning stage, or both.

As noted above, the froth flotation step can be improved by the inclusion of auxiliary collectors in addition to the collectors of the present invention. The most common auxiliary collectors are hydrocarbon compounds which contain anionic or cationic polar groups. Examples include the fatty acids, the fatty acid soaps, xanthates, xanthate esters, xanthogen formates, thionocarbamates, other dithiocarbamates, fatty sulfates, fatty sulfonates, mercaptans, thioureas, dialkyldithiophosphates and dialkyldithiophosphinates.

One group of xanthate collectors which has been utilized in froth flotation processes may be represented by the formula $$R_7-O-\overset{\overset{\displaystyle S}{\|}}{C}SM$$

wherein $R_7$ is an alkyl group containing from 1 to 6 carbon atoms and M is a dissociating cation such as sodium or potassium. Examples of such xanthates include potassium amyl xanthate, sodium amyl xanthate, etc.

The thionocarbamates useful as auxiliary collectors include the dialkylthionocarbamates represented by the formula $$R_8OC\overset{\overset{\displaystyle S}{\|}}{N}HR_9$$

wherein $R_8$ and $R_9$ are alkyl groups. U.S. Pat. Nos. 2,691,635 and 3,907,854 describe processes for preparing dialkylthionocarbamates as represented by the above formula. These two patents are incorporated by reference herein for their disclosures of the methods of preparing suitable auxiliary collectors useful in this invention.

Hydrocarboxycarbonyl thionocarbamate compounds also have been reported as useful collectors. The hydrocarboxycarbonyl thionocarbamate compounds are represented by the formula $$R_{10}OC\overset{\overset{\displaystyle O}{\|}}{N}(H)\overset{\overset{\displaystyle S}{\|}}{C}OR_{11}$$

wherein $R_{10}$ and $R_{11}$ are each independently selected from saturated and unsaturated hydrocarbyl groups, alkyl polyether groups and aromatic groups. The preparation of these hydrocarboxycarbonyl thionocarbamic compounds and their use as collectors is described in U.S. Pat. No. 4,584,097, the disclosure of which is hereby incorporated by reference. Specific examples of auxiliary collectors which may be utilized in combination with the collectors of the present invention include: sodium isopropyl xanthate, isopropyl ethyl thionocarbamate, N-ethoxycarbonyl,N'-isopropylthiourea, etc.

Dihydrocarbyldithiophosphates are useful as collectors. The dihydrocarbyldithiophosphoric acid may be represented by the Formula

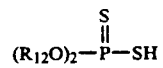

wherein each $R_{12}$ is independently a hydrocarbyl group having 1 to about 18 carbon atoms. Lower alkyl dialkyldithiophosphoric acids are known collectors. Lower alkyl groups are alkyl groups having 7 or fewer carbon atoms such as propyl, butyl, amyl or hexyl. Dicresyldithiophosphoric acids are also known as collectors. Ammonium or metal salts, such as sodium, potassium, or zinc, of the above dithiophosphoric acids are useful.

In the flotation step (B), the slurry is frothed for a period of time which maximizes gold recovery. The precise length of time is determined by the nature and particle size of the ore as well as other factors, and the time necessary for each individual ore can be readily determined by one skilled in the art. Typically, the froth flotation step is conducted for a period of from 2 to about 20 minutes and more generally from a period of about 5 to about 15 minutes. As the flotation step proceeds, small amounts of collectors may be added periodically to improve the flotation of the desired mineral values. Additional amounts of the collector of the present invention may be added periodically to the rougher concentrate and included in the slurry. In one preferred embodiment, the collectors present during the froth flotation comprise a mixture of one or more of the dithiocarbamates of the invention with one or more dithiophosphoric acid or salt, xanthate or thionocarbamate.

When the froth flotation has been conducted for the desired period of time, the gold rougher concentrate is collected, and the gold rougher tailing product is removed and may be subjected to further purification.

The recovered gold rougher concentrate is processed further to improve the gold grade and reduce the impurities within the concentrate. One or more cleaner flotation stages can be employed to improve the gold grade to a satisfactory level without unduly reducing the overall gold recovery of the system. Generally, two cleaner flotation stages have been found to provide satisfactory results.

Prior to cleaning, however, the gold rougher concentrate is finely reground to reduce the particle size to a desirable level. In one embodiment, the particle size is reduced so that 60% of the particles are less than 400 mesh (35 microns). The entire gold rougher concentrate can be comminuted to the required particle size or the rougher concentrate can be classified and only the oversized materials comminuted to the required particle size. The copper rougher concentrate can be classified by well-known means such as hydrocyclones. The particles larger than desired are reground to the proper size and are recombined with the remaining fraction.

The reground gold rougher concentrate then is cleaned in a conventional way by forming an aqueous slurry of the reground gold rougher concentrate in water. One or more frothers and one or more collectors are added to the slurry which is then subjected to a froth flotation. The collector utilized in this cleaner stage may be one or more of the collectors of the present invention and/or any of the auxiliary collectors described above. In some applications, the addition of collector and a frother to the cleaning stage may not be necessary if sufficient quantities of the reagents have been carried along with the concentrate from the preceding gold rougher flotation. The duration of the first gold cleaner flotation is a period of from about 5 to about 20 minutes, and more generally for about 8 to about 15 minutes. At the end of the cleaning stage, the froth containing the gold cleaner concentrate is recovered and the underflow which contains the gold cleaner tailings is removed. In one preferred embodiment, the gold cleaner concentrate recovered in this manner is subjected to a second cleaning stage and which the requirements for collector and frother, as well as the length of time during which the flotation is carried out to obtain a satisfactory gold content and recovery can be readily determined by one skilled in the art.

In another embodiment, the slurry from step (A) is subjected to conditioning with sulfurous acid. The conditioning acts to suppress iron. The conditioning step is especially useful with copper ores. After the ore slurry has been prepared in accordance with any of the embodiments described above, it is useful in some flotation procedures to condition the slurry with sulfur dioxide under aeration at a pH of from about 5.5 to about 7.5. The conditioning medium may be an aqueous solution formed by dissolving sulfur dioxide in water forming sulfurous acid ($H_2SO_3$). It has been found that when certain ore slurries, especially copper ore slurries, are conditioned with sulfurous acid and aerated, the $SO_2$ increases the flotation rate of copper minerals, and depresses the undesired gangue and undesirable minerals such as iron. The conditioning results in the recovery of a product, in subsequent treatment stages, that represents a surprising high recovery of copper values and a surprising low retention of iron. The amount of sulfur dioxide added to the slurry in the conditioning step can be varied over a wide range, and the precise amounts useful for a particular ore or flotation process can be readily determined by one skilled in the art. In general, the amount of sulfur dioxide utilized in the conditioning step is within the range of from about 500 to about 5000 of sulfur dioxide per million parts of ground ore. The pH of the conditioned slurry should be maintained between about 5.5 and about 7.5, more preferably between about 6.0 to about 7.0. A pH of about 6.5 to about 7.0 is particularly preferred for the conditioned slurry.

Conditioning of the slurry is achieved by agitating the pulp contained in a conditioning tank such as by vigorous aeration and optionally, with a suitable agitator such as a motor-driven impeller, to provide good solid-liquid contact between the finely divided ore and the sulfurous acid. The pulp is conditioned sufficiently long to maximize depression of the undesirable minerals and gangue while maximizing activation of the desired minerals such as copper minerals. Thus, conditioning time will vary from ore to ore, but it has been found for the ores tested that conditioning times of between about 1 to 10 minutes and more generally from about 3 to 7 minutes, provide adequate depression of the undesirable minerals and gangue.

One of the advantages of the conditioning step is that it allows recovery of a concentrate having satisfactory copper content without requiring the introduction of lime, cyanide or other conditioning agents to the flotation circuit, although as mentioned above, the introduction of some lime frequently improves the results obtained. Omitting these other conditioning agents, or reducing the amounts of lime or other conditioning agents offers relief for both the additional costs and the environmental and safety factors presented by these agents. However, as noted below, certain advantages are obtained when small amounts of such agents are utilized in the flotation steps.

When using the sulfurous acid conditioning step, the flotation of copper is effected in the copper rougher stage at a slightly acidic pulp pH which is generally between about 6.0 and 7.0, the pH being governed by the quantity of sulfur dioxide used during the conditioning and aeration as well as the quantity of any inorganic base included in the slurry.

The following examples illustrate the process of the present invention. Unless otherwise indicated, in the examples and elsewhere in the specification and claims, all parts and percentages are by weight, and temperatures are in degrees Centrigrade. Also in the following examples, the amount of reagents added are expressed in parts per million parts of dry ore.

The following table contains results of a gold flotation process using the collectors of the present invention and Aerofloat® 25, a dicresyldithiophosphoric acid collector available from American Cyanamid Chemical Company. All parts are parts per million parts of ore. The assay of the gold ore is contained in the following table. The ore, collector (amount shown in table below), and 150 parts of sodium carbonate are ground for 10 minutes at 60% solids. Seven percent of the particles are greater than 100 mesh. The slurry is conditioned for one minute at 30% solids in the presence of 75 parts of collector and 16 parts methylisobutylcarbinol. The pH of the conditioning step is approximately 8.5. The slurry is then subjected to froth flotation for ten minutes followed by a second conditioning step. The second conditioning of the slurry occurs for one minute in the presence of 6 parts of methylisobutylcarbinol and 2.5 parts of potassium amyl xanthate. The slurry is subjected to a second froth flotation for 7 minutes.

TABLE

| Collector | Amount of Gold in Ore | % Ore Recovery | % Gold Recovery |
|---|---|---|---|
| Product of Example[1] | 1.53 ppm[1] | 11.8 | 94.2 |
| Aerofloat ®25 | 1.84 ppm | 15.1 | 95.1 |

[1]ppm = parts of gold per million parts of ore

The gold recovery of the collectors of the present invention and commercially available collector are similar. The amount of gold (0.094 ppm) left in the tail from the beneficiation is the same for both collectors. However, the collectors of the present invention recovered 22% less ore than the commercially available collector. The reduced amount of recovered ore provides substantial cost savings in later processing and transport procedures involving the metal values.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A mineral recovery process comprising the steps of:

(A) forming a slurry comprising a crushed ore containing at least one mineral, water and a mineral collector which is at least one dithiocarbamate represented by the formula:

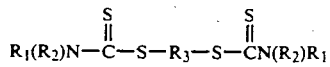

$$R_1(R_2)N-\overset{\overset{\displaystyle S}{\|}}{C}-S-R_3-S-\overset{\overset{\displaystyle S}{\|}}{C}N(R_2)R_1 \quad (I)$$

wherein each $R_1$ is independently hydrogen, a hydrocarbyl group having from 1 to about 18 carbon atoms, or $R_1$ taken together with $R_2$ and the nitrogen atom form a five, six or seven member heterocyclic group; each $R_2$ is independently a hydrocarbyl group having from 1 to about 18 carbon atoms, or $R_2$ taken together with $R_1$ and the nitrogen atom form a five, six or seven member heterocyclic group; and $R_3$ is a divalent hydrocarbon group; having from 1 to about 10 carbon atoms;

(B) subjecting the slurry from step (A) to froth flotation to produce a froth containing said mineral; and (C) recovering said mineral from the froth.

2. The process of claim 1 wherein each $R_1$ is independently hydrogen or a hydrocarbyl group having from 1 to about 8 carbon atoms; and each $R_2$ is independently a hydrocarbyl group having from 1 to about 8 carbon atoms.

3. The process of claim 1 wherein each $R_1$ is independently hydrogen or a propyl, butyl, or amyl group and each $R_2$ is independently a propyl, butyl, or amyl group.

4. The process of claim 1 wherein $R_1$ and $R_2$ taken together with the nitrogen atom form a pyrrolidinyl or piperidinyl group.

5. The process of claim 1 wherein one $R_1$ and $R_2$ taken together with the nitrogen atom form a pyrrolidinyl or a piperidinyl group, and the other $R_1$ is hydrogen or a propyl, butyl, or amyl group and the other $R_2$ is a propyl, butyl, or amyl group.

6. The process of claim 1 wherein $R_3$ is an alkylene group.

7. The process of claim 1 wherein $R_3$ is a methylene or ethylene group.

8. The process of claim 1 wherein $R_3$ is an arylene, alkarylene, or arylalkylene group containing from 6 to about 10 carbon atoms.

9. The process of claim 1, wherein the mineral comprises a gold- or copper-containing mineral.

10. The process of claim 1, wherein step (A) further comprises:

including an inorganic base in the slurry.

11. The process of claim 10, wherein the inorganic base is an alkali metal or alkaline earth metal oxide or hydroxide.

12. The process of claim 10 wherein the inorganic base is calcium hydroxide.

13. The process of claim 1 wherein the process further comprises:

conditioning the slurry from step (A) with $SO_2$ until the slurry from step (A) has a pH of from about 4.5 to about 7.0 prior to step (B).

14. The process of claim 1 wherein the collector is present in an amount from about 0.5 to about 500 parts of collector per million parts of ore.

15. A mineral recovery process comprising the steps of:

(A) forming a slurry comprising at least one crushed gold or copper mineral containing ore, water, and from about 0.5 to about 500 parts of at least one gold or copper collector per million parts of ore wherein the gold or copper collector is at least one dithiocarbamate represented by the formula $$R_1(R_2)N-\overset{\overset{\displaystyle S}{\|}}{C}-S-R_3-S-\overset{\overset{\displaystyle S}{\|}}{C}N(R_2)R_1 \quad (I)$$

wherein each $R_1$ is independently a hydrogen, an alkyl group having from 1 to about 8 carbon atoms or $R_1$ taken together with $R_2$ and the nitrogen atom form a pyrrolidinyl or a piperidinyl group; each $R_2$ is independently an alkyl group having from 1 to about 8 carbon atoms or $R_2$ taken together with $R_1$ and the nitrogen atom form a pyrrolidinyl or a piperidinyl group, and $R_3$ is an divalent hydrocarbon group having from 1 to about 10 carbon atoms;

(B) subjecting the slurry from step (A) to froth flotation to produce a froth; and (C) recovering said gold or copper mineral from the froth.

16. The process of claim 15 wherein each $R_1$ is independently a hydrogen or a propyl, butyl, or amyl group and each $R_2$ is independently a propyl, butyl, or amyl group.

17. The process of claim 15 wherein $R_3$ is a methylene or ethylene group.

18. The process of claim 15 wherein one $R_1$ and $R_2$ taken together with the nitrogen atom form a pyrrolidinyl or piperidinyl group; the other $R_1$ is independently hydrogen or a propyl, butyl, or amyl group; and the other $R_2$ is independently a propyl, butyl, or amyl group.

19. The process of claim 15, wherein step (A) further comprises: including an inorganic base in the slurry.

20. The process of claim 19, wherein the inorganic base is an alkali metal or alkaline earth metal oxide or hydroxide.

21. The process of claim 15, wherein the process further comprises:

conditioning the slurry from step (A) with $SO_2$ until the slurry from step (A) has a pH of from about 4.5 to about 7.0 prior to step (B).

22. The process of claim 1, further comprising (D) cleaning and upgrading the minerals recovered in step (C).

* * * * *